US009291070B2

(12) United States Patent
Fielding et al.

(10) Patent No.: US 9,291,070 B2
(45) Date of Patent: Mar. 22, 2016

(54) GAS TURBINE ROTOR CONTAINMENT

(75) Inventors: Bruce Fielding, Glen Williams (CA); Assaf Farah, Charlemagnes (CA); Karl D. Blume, Hebron, CT (US); Lam Nguyen, Brossard (CA); Theodore W Kapustka, Glastonbury, CT (US)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 868 days.

(21) Appl. No.: 13/309,709

(22) Filed: Dec. 2, 2011

(65) Prior Publication Data

US 2012/0141294 A1 Jun. 7, 2012

Related U.S. Application Data

(60) Provisional application No. 61/419,596, filed on Dec. 3, 2010.

(51) Int. Cl.

| | |
|---|---|
| ***F01D 25/00*** | (2006.01) |
| ***F01D 21/04*** | (2006.01) |
| ***F01D 5/02*** | (2006.01) |

(52) U.S. Cl.

CPC ..... *F01D 21/045* (2013.01); *F01D 5/026* (2013.01); *F05D 2260/31* (2013.01)

(58) Field of Classification Search

CPC ..... F01D 5/026; F01D 21/04; F01D 21/045
USPC ..... 415/9, 68, 69, 216.1; 416/2, 126, 244 R
See application file for complete search history.

(56) References Cited

U.S. PATENT DOCUMENTS

| | | | |
|---|---|---|---|
| 2,679,907 | A | 6/1954 | Frankland |
| 2,866,522 | A | 12/1958 | Morley et al. |
| 2,930,188 | A | 3/1960 | Haworth et al. |
| 2,999,000 | A | 9/1961 | Spat |
| 3,680,803 | A | 8/1972 | Takata |
| 3,910,651 | A | 10/1975 | Pearce et al. |
| 4,039,848 | A | 8/1977 | Winderl |
| 4,086,012 | A | 4/1978 | Buckley et al. |
| 4,211,424 | A | 7/1980 | Stein |
| 4,283,096 | A | 8/1981 | Picard et al. |
| 4,313,712 | A | 2/1982 | Briggs |

(Continued)

FOREIGN PATENT DOCUMENTS

| | | | |
|---|---|---|---|
| EP | 162340 | A1 | 11/1985 |
| EP | 468782 | A2 | 1/1992 |

(Continued)

*Primary Examiner* — Igor Kershteyn
*Assistant Examiner* — Jesse Prager
(74) *Attorney, Agent, or Firm* — Norton Rose Fulbright Canada Corp.

(57) ABSTRACT

A gas turbine engine has a spool including compressor and turbine rotors connected by a first shaft. The first shaft extends concentrically around a second shaft. The first shaft forward end has a portion with an inner diameter of close tolerance with the second shaft. The second shaft has a region of enlarged diameter located axially aft of the compressor rotor but axially forward of the forward end of the first shaft. The region of enlarged diameter has a diameter greater than the inner diameter of the forward end portion of the first shaft to cause the region of enlarged diameter of the second shaft to engage the first shaft in interference in the event that the second shaft is moved axially aft relative to the first shaft more than a pre-selected axial distance.

7 Claims, 2 Drawing Sheets

(56) References Cited

U.S. PATENT DOCUMENTS

| | | | | |
|---|---|---|---|---|
| 4,548,546 | A | 10/1985 | Lardellier | |
| 4,972,986 | A | 11/1990 | Lipschitz | |
| 4,998,949 | A | 3/1991 | Cantwell | |
| 5,407,386 | A | 4/1995 | Kish et al. | |
| 5,433,584 | A | 7/1995 | Amin et al. | |
| 5,537,814 | A * | 7/1996 | Nastuk et al. | 60/796 |
| 6,098,399 | A | 8/2000 | Richards et al. | |
| 6,109,022 | A | 8/2000 | Allen et al. | |
| 6,240,719 | B1 | 6/2001 | Vondrell et al. | |
| 6,249,070 | B1 | 6/2001 | Sharp | |
| 6,491,497 | B1 | 12/2002 | Allmon et al. | |
| 6,827,548 | B2 | 12/2004 | Coxhead et al. | |
| 6,986,637 | B2 | 1/2006 | Coxhead | |
| 7,195,444 | B2 | 3/2007 | Brault et al. | |
| 7,322,180 | B2 | 1/2008 | Lapergue et al. | |
| 7,453,176 | B2 | 11/2008 | Davison | |
| 7,640,802 | B2 | 1/2010 | King et al. | |
| 7,654,535 | B2 | 2/2010 | Cross et al. | |
| 7,874,136 | B2 | 1/2011 | Heyerman | |
| 2003/0049118 | A1 | 3/2003 | Bruno et al. | |
| 2003/0127927 | A1 | 7/2003 | Razzell et al. | |
| 2004/0240985 | A1 | 12/2004 | Stephenson et al. | |
| 2006/0097589 | A1 | 5/2006 | Gerez et al. | |
| 2006/0267290 | A1 | 11/2006 | Spencer et al. | |
| 2007/0205681 | A1 | 9/2007 | Corbin | |
| 2009/0139201 | A1 | 6/2009 | Storace | |
| 2010/0124495 | A1 * | 5/2010 | Bifulco | 415/216.1 |
| 2010/0239424 | A1 * | 9/2010 | Maalouf et al. | 416/219 R |
| 2011/0085906 | A1 | 4/2011 | Scothern | |
| 2011/0146298 | A1 | 6/2011 | Reinhardt et al. | |
| 2011/0219781 | A1 * | 9/2011 | Benjamin et al. | 60/796 |
| 2011/0223026 | A1 * | 9/2011 | Benjamin et al. | 416/198 A |
| 2012/0107098 | A1 * | 5/2012 | Tirone et al. | 415/122.1 |
| 2012/0141294 | A1 | 6/2012 | Fielding et al. | |

FOREIGN PATENT DOCUMENTS

| | | | |
|---|---|---|---|
| EP | 633977 | B1 | 7/1996 |
| GB | 182700 | A | 7/1922 |
| GB | 903945 | A | 8/1962 |
| GB | 1059435 | A | 2/1967 |
| GB | 1085619 | A | 10/1967 |
| GB | 1504820 | A | 3/1978 |
| GB | 2165018 | A | 4/1986 |
| WO | WO 2007051443 | A1 * | 5/2007 |
| WO | WO2012036684 | A1 | 3/2012 |

* cited by examiner

GAS TURBINE ROTOR CONTAINMENT

CROSS-REFERENCE TO RELATED APPLICATIONS

This application claims priority on U.S. Provisional Application No. 61/419,596 filed on Dec. 3, 2010, the content of which is hereby incorporated by reference.

TECHNICAL FIELD

The present application relates generally to gas turbine engines and more particularly to rotor containment for multi-shaft gas turbine engines.

BACKGROUND ART

A gas turbine engine is designed to safely shut down following the ingestion of a foreign object or blade loss event. Efficient design practice results in close inter-shaft clearances in concentric multi-shaft designs. The disturbance from these events on the rotor stability can lead to shaft-to-shaft rubbing at speeds and forces sufficient to result in separation of one or more affected shafts. The engine must be designed to contain the structure during subsequent deceleration of the rotors. The use of a full length tie-shaft to join the compressor and turbine rotor sections further complicates the containment design. Furthermore, if a shaft separation event occurs, separating loads such as gas pressure will tend to split the compressor and turbine rotor sections (i.e. release of compressor pressure tends to force the turbine rotor aft), further complicating containment by providing two rotating masses to contain.

SUMMARY

According to a general aspect, there is provided a gas turbine engine comprising at least one spool assembly including at least a compressor rotor and a turbine rotor connected by a first shaft, the first shaft having a forward end connected to the compressor rotor and an aft end connected to the turbine rotor, the first shaft extending concentrically around a second shaft, the second shaft having a region of enlarged diameter located axially aft of the compressor rotor but axially forward of the forward end of the first shaft; the region of enlarged diameter having a diameter greater than an inner diameter of at least a portion of the forward end of the first shaft to cause the region of enlarged diameter of the second shaft to axially engage the first shaft in interference in the event that the second shaft is moved axially aft relative to the first shaft more than a pre-selected axial distance.

In accordance with a second aspect, there is provided a gas turbine engine comprising a low pressure spool assembly including at least a fan and a low pressure turbine connected by a low pressure shaft, a high pressure spool assembly including at least a high pressure compressor rotor and a high pressure turbine rotor connected by a high pressure shaft and a tie shaft, the high pressure shaft extending concentrically around the tie shaft, the tie-shaft having a region of enlarged diameter located axially aft of the high pressure compressor rotor but axially forward of a front end of the high pressure shaft, the region of enlarged diameter configured to cause the region to engage the high pressure shaft in an interference fit in the event that the region is moved axially aft relative to the high pressure shaft more than a pre-selected axial distance.

BRIEF DESCRIPTION OF THE DRAWINGS

Reference is now made to the accompanying figures in which.

DETAILED DESCRIPTION

Figure 1:
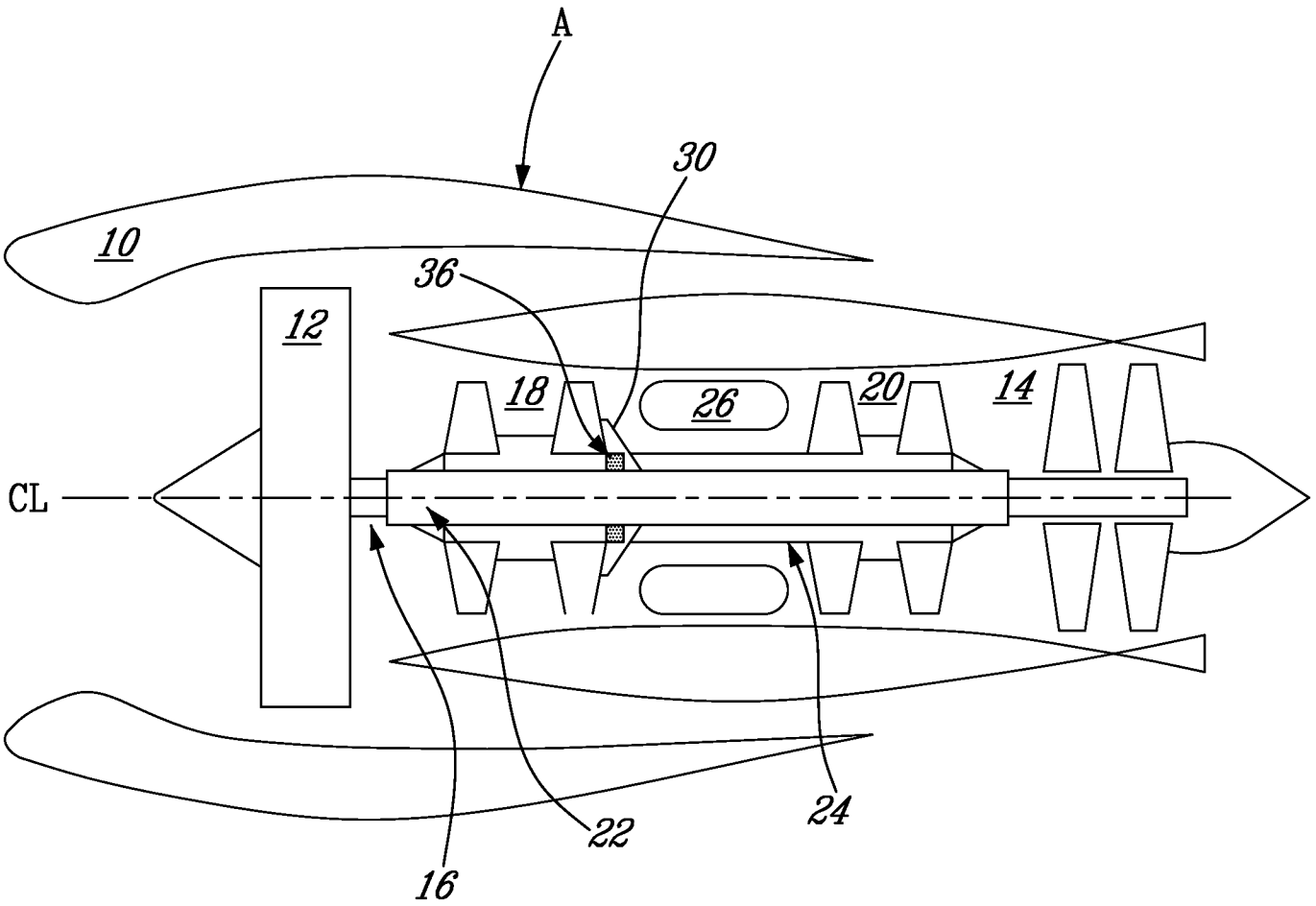
FIG. 1 is a schematic cross-sectional view of a gas turbine engine illustrating the multi-shaft configuration.

FIG. 1 schematically depicts a turbofan engine A which, as an example, illustrates the application of the described subject matter. The turbofan engine A includes a nacelle 10, a low pressure spool assembly which includes at least a fan 12 and a low pressure turbine 14 connected by a low pressure shaft 16, and a high pressure spool which includes a high pressure compressor 18 and a high pressure turbine 20 connected by a tie-shaft 22 and a high pressure shaft 24. The engine further comprises a combustor 26.

Figure 2:
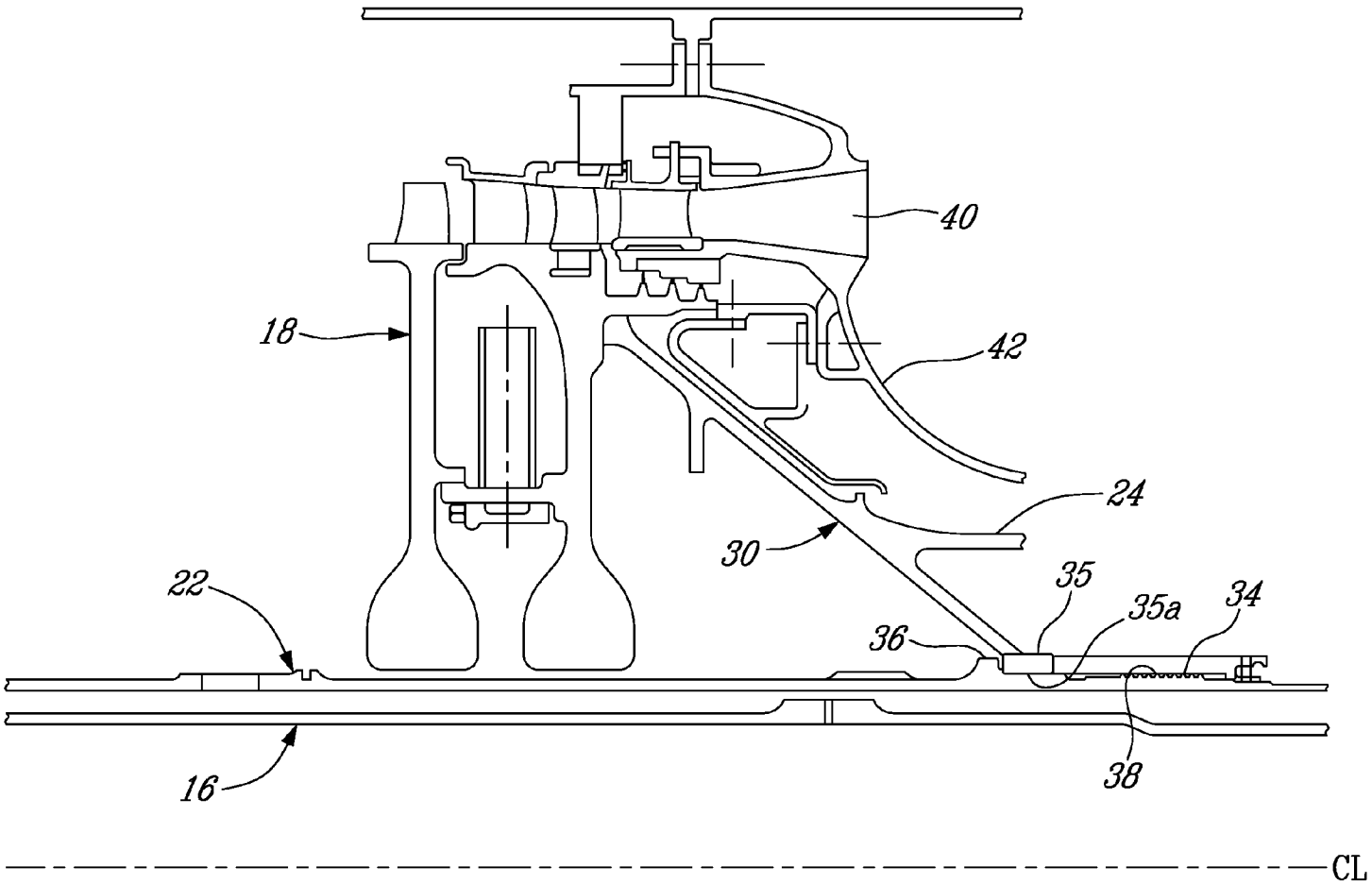
FIG. 2 is a partly fragmented axial cross-sectional view of a portion of a high pressure shaft and a tie shaft of the gas turbine engine shown in FIG. 1.

As can be seen more clearly in FIG. 2, the upstream end of the high pressure shaft 24 terminates in a bell shaped support 30. The support 30 has a collar 35 having an internal diameter 35*a* that has a close radial tolerance with the tie-shaft 22. Threads 38 may be provided on the outside diameter of the tie shaft 22 for engagement with a threaded coupling 34 axially downstream of collar 35 of the high pressure shaft 24. The tie-shaft 22 includes a catcher 36, which may be provided as an integral portion of the tie-shaft 22, with an increased outer diameter portion that is at least greater than an inside diameter 35*a* of the collar 35, depending from the high pressure shaft 24, through which the tie-shaft 22 extends.

The catcher 36 is located downstream of the high pressure compressor 18, but axially upstream of where the tie-shaft 22 enters the high pressure shaft 24, with close axial tolerances. Since the catcher 36 is radially larger than the inner diameter 35*a* of collar 35 of the high pressure shaft 24, the catcher portion 36 is too large to slide axially through the high pressure shaft 24. Axial movement of the catcher 36, aft relative to the high pressure shaft 24 will cause interference between the catcher 36 and the high pressure shaft collar 35, effectively restraining the tie-shaft 22 from moving downstream relative to high pressure shaft 24 which can be seen as joining the tie shaft 22 with the high pressure shaft 24.

It is to be understood that although the present embodiment relates to a tie-shaft 22 arranged to be retained by the high pressure shaft 24, it is contemplated that a similar configuration can be designed with a low compressor shaft having a potential interference with a high pressure shaft in order to restrain the low pressure shaft in the event of a rotor imbalance and shaft separation.

It will be appreciated that, during a shaft shear event in which shaft rubbing causes the tie-shaft 22 to rupture or shear, separating loads such as gas pressure will tend to split the compressor and turbine rotor sections 18 and 20 (i.e. release of compressor pressure tends to force the turbine rotor 20 aft, relative to the compressor rotor 18). The presence of the catcher 36 on the tie shaft 22, however, continues to maintain the compressor and turbine rotors 18, 20 as a single mass, and hence will tend to draw the high compressor rotor 18 aft during the event, along with the turbine rotor 20. Thus, rotor separation is impeded.

Furthermore, the presence of the bell shaped support 30 on the high pressure shaft 24 tends to have a centering effect on the high pressure compressor rotor 18. The centralizing function provides a conical contact zone on the rotor 18, which provides axial and radial restraint. This reduces reliance on features such as seals and aerofoils to centralize the rotor if the mid rotor radial connection is lost and promotes energy dissipation between the set of more structurally capable rotating and static components.

During a shaft separation event, as the compressor rotor 18 is drawn axially rearward by the rearward movement of the turbine rotor 20, multiple structures of the engine, such as the compressor diffuser 40, bearing housings, support cases 42, and gas-path vane structures will be crushed in sequence to absorb the energy in a manner so as to progressively arrest the rotor aft movement following the event. The structures may be closely coupled to the rotor through spacers or other adjusting features such that the rotating and static parts come into contact early after the event, to absorb the kinetic energy of the rotors by a set of crushable features of the components designed to plastically deform in a manner to protect surrounding hardware. In addition to providing containment, the engagement between static and rotating structures also provides a mechanical braking feature to preclude turbine rotational overspeed as the stored energies in the engine are exhausted in rundown.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the scope of the appended claims.

The invention claimed is:

1. A gas turbine engine comprising at least one spool assembly including at least a compressor rotor and a turbine rotor connected by a first shaft, the first shaft having a forward end connected to the compressor rotor and an aft end connected to the turbine rotor, the first shaft extending concentrically around a second shaft, the second shaft having a region of enlarged diameter located axially aft of the compressor rotor but axially forward of the forward end of the first shaft; the region of enlarged diameter having a diameter greater than an inner diameter of at least a portion of the forward end of the first shaft to cause the region of enlarged diameter of the second shaft to axially engage the first shaft in interference in the event that the second shaft is moved axially aft relative to the first shaft more than a pre-selected axial distance, wherein a bell shape support extends forwardly from the forward end of the first shaft, and wherein the first shaft is provided with a collar at the forward end thereof, the collar providing an axially arresting surface for the second shaft.

2. The gas turbine engine as defined in claim 1 wherein the first shaft is a high pressure shaft and the second shaft is a tie-shaft coupling the compressor rotor to the turbine rotor.

3. The gas turbine engine as defined in claim 2 wherein the spool assembly is a high pressure spool including a high pressure compressor and a high pressure turbine connected by the tie-shaft and the high pressure shaft.

4. The gas turbine engine as defined in claim 3 wherein a low pressure shaft extends concentrically within the tie-shaft; the low pressure shaft being connected at its aft end, beyond the tie-shaft to a low pressure turbine and at its front end, beyond the tie-shaft to a fan.

5. The gas turbine engine as defined in claim 1 wherein the bell shaped support abuts the compressor rotor thereby providing a conical contact zone and serving, in the case of a shaft shear, a centering effect on the compressor rotor, which provides axial and radial restraint to the rotor compressor rotor.

6. A gas turbine engine comprising a low pressure spool assembly including at least a fan and a low pressure turbine connected by a low pressure shaft, a high pressure spool assembly including at least a high pressure compressor rotor and a high pressure turbine rotor connected by a high pressure shaft and a tie-shaft, the high pressure shaft extending concentrically around the tie-shaft; the tie-shaft having a region of enlarged diameter located axially aft of the high pressure compressor rotor but axially forward of a forward end of the high pressure shaft, the region of enlarged diameter configured to cause the region to engage the high pressure shaft in an interference fit in the event that the region is moved axially aft relative to the high pressure shaft more than a pre-selected axial distance, wherein the region of enlarged diameter is a radially projecting collar formed on the tie-shaft having a diameter greater than an internal diameter of the high pressure shaft at the location of the intended interference fit in the event of a tie-shaft shear upstream of the forward end of the high pressure shaft.

7. The gas turbine engine as defined in claim 6, wherein the high pressure shaft includes a bell shape support at the front end thereof abutting the high pressure compressor rotor, thus providing a conical contact zone and serving, in the case of a shaft shear, a centering effect on the compressor rotor, which provides axial and radial restraint to the rotor compressor rotor.

* * * * *